US008631664B2

(12) United States Patent
Shibuya et al.

(10) Patent No.: US 8,631,664 B2
(45) Date of Patent: Jan. 21, 2014

(54) AIR CONDITIONER WITH AUTOMATIC AIR FILTER CLEANER

(75) Inventors: Makoto Shibuya, Kanagawa (JP); Shinji Sugiyama, Kanagawa (JP); Hideyuki Umenaka, Kanagawa (JP); Hideo Okamoto, Kanagawa (JP); Ritsushi Taira, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 555 days.

(21) Appl. No.: 12/352,816

(22) Filed: Jan. 13, 2009

(65) Prior Publication Data

US 2009/0183521 A1 Jul. 23, 2009

(30) Foreign Application Priority Data

Jan. 18, 2008 (JP) ..... 2008-008788

(51) Int. Cl.
*A23L 3/36* (2006.01)
*F25D 17/04* (2006.01)

(52) U.S. Cl.
USPC ..... 62/303; 62/317

(58) Field of Classification Search
USPC ..... 62/317, 303; 55/290, 304, 305
See application file for complete search history.

(56) References Cited

U.S. PATENT DOCUMENTS 5,232,477 A * 8/1993 Kurr et al. ..... 95/277
7,544,223 B2 * 6/2009 Oda et al. ..... 55/289

FOREIGN PATENT DOCUMENTS

JP 2005-024135 1/2005
JP 2007-100975 4/2007
JP 2007-101112 4/2007
JP 2007-107764 4/2007
JP 2007100975 A * 4/2007
JP 2007101112 A * 4/2007
JP 2007-198678 8/2007
JP 2007198678 A * 8/2007

OTHER PUBLICATIONS

Yoshikawa, Kazuya, JP 2007100975 A, Apr. 2007, English machine translation.*
Shimizu et al, JP 2007101112 A, Apr. 2007, English machine translation.*
Tanigawa et al, JP 2007198678 A, Aug. 2007, English machine translation.*

* cited by examiner

*Primary Examiner* — John Pettitt
*Assistant Examiner* — Ignacio E Landeros
(74) *Attorney, Agent, or Firm* — Venable LLP; Michael A. Sartori; Tamatane J. Aga

(57) ABSTRACT

There are provided a first guide channel 240 for making a U-turn of a leading end of a filter 3 at a front side of a main unit cabinet 1 during forward movement of the filter 3 and a second guide channel 141 for drawing a rear end of the filter to a rear surface side of the main unit cabinet 1 during backward movement of the filter 3.

5 Claims, 14 Drawing Sheets

AIR CONDITIONER WITH AUTOMATIC AIR FILTER CLEANER

BACKGROUND OF THE INVENTION

The present invention relates to an indoor unit of an air conditioner having a filter cleaning function for automatically cleaning dust adhering to a filter and, more particularly, an air conditioner in which one filter and another filter are asynchronously driven at the time of initialization of the two filters.

As described in; for instance, Patent Document 1, some of indoor units of recent air conditioners have a filter cleaning function for automatically removing dust adhering to filters.

The filter cleaning function is fulfilled by means of filters attached to a main unit cabinet so as to close air inlets and a cleaning unit for collecting dust adhering to the filters. The filters are usually caused to pass through the cleaning unit, thereby collecting the dust adhering to the filters by means of the cleaning unit.

A method for cleaning the filters includes two methods; namely, a method for moving a cleaning unit while fixing a filter and another method for moving the filters while the cleaning unit is held stationary. Under the former method, the cleaning unit is moved, and hence complicate movement and power for effecting the movement are required.

Accordingly, in many instances, the latter method for moving the filters is adopted. However, when the filters are moved, a space for reciprocal front-and-back movement of the filters is required. Hence, in Patent Document 1, the filters are withdrawn to the outside of the main unit cabinet. Moreover, in Patent Document 2, a portion of the filter is turned in the shape of the letter U, and the filter is reciprocally moved within the main unit cabinet.

[Patent Document 1] JP-A-2007-107764

[Patent Document 2] JP-A-2007-198678

However, in the air conditioner defined in Patent Document 2, the air inlets are positioned only on an upper surface side of the main unit cabinet; hence, filters are short, and the essential requirement is to arrange, on the front side of the main unit cabinet, an alternative path for executing a U-turn of a portion of the filter.

In the air conditioner in which the air inlets are formed from a front surface to an upper surface of the main unit cabinet, the filters become larger correspondingly. For this reason, even when the U-turn mechanism described in Patent Document 2 is used, bypassing the front surface of the filter is impossible.

SUMMARY OF THE INVENTION

Accordingly, in order to solve the foregoing problem, the present invention provides an air conditioner in which air inlets are formed from a front surface to an upper surface of a main unit cabinet, wherein filters can be reciprocally moved within the main unit cabinet.

In order to achieve the object, according to a first aspect of the present invention, there is provided an air conditioner including:

a main unit cabinet that has an air inlet and an air outlet and that houses at least a heat exchanger and a blow fan;

a dust removal filter disposed opposite the air inlet within the main unit cabinet;

a cleaning section for removing dust adhering to the filter within the main unit cabinet; and a movement section for moving the filter within the main unit cabinet, wherein the air inlet is formed from a front surface to an upper surface of the main unit cabinet;

a filter travel channel for the filter that is reciprocally moved by the movement section is provided in the main unit cabinet; and a first guide channel for making a U-turn of a leading end of the filter at a front surface side of the main unit cabinet during forward movement of the filter and a second guide channel for guiding a rear end of the filter to a rear surface side of the main unit cabinet during backward movement of the filter are provided in the filter travel channel.

According to a second aspect of the invention, there is provided the air conditioner according to the first aspect, further including:

sensors disposed in a space surrounded by the first guide channel formed in the shape of the letter U.

According to a third aspect of the invention, there is provided the air conditioner according to the first or second aspect, wherein a trailing end of the first guide channel is merged with a part of the filter travel channel close to the second guide channel, and a leading end of the filter folded by the first guide channel is intruded to the filter movement channel.

According to a forth aspect of the invention, there is provided the air conditioner according to any one of the first, second and third aspect, wherein a part of the filter covering a front surface side of the main unit cabinet is first cleaned, and a part of the filter covering an upper side of the main unit cabinet is then cleaned.

During forward movement of the filter, a first bypass channel formed on the front surface of the main unit cabinet makes a U-turn of a leading end of the filter. At the time of backward movement of the filter, the filter is drawn into a second bypass channel formed on the rear side of the main unit cabinet, thereby enabling movement of the filter without drawing a large-size filter out of an indoor unit.

DETAILED DESCRIPTION OF THE PREFERRED EMBODIMENTS

Figure 1:
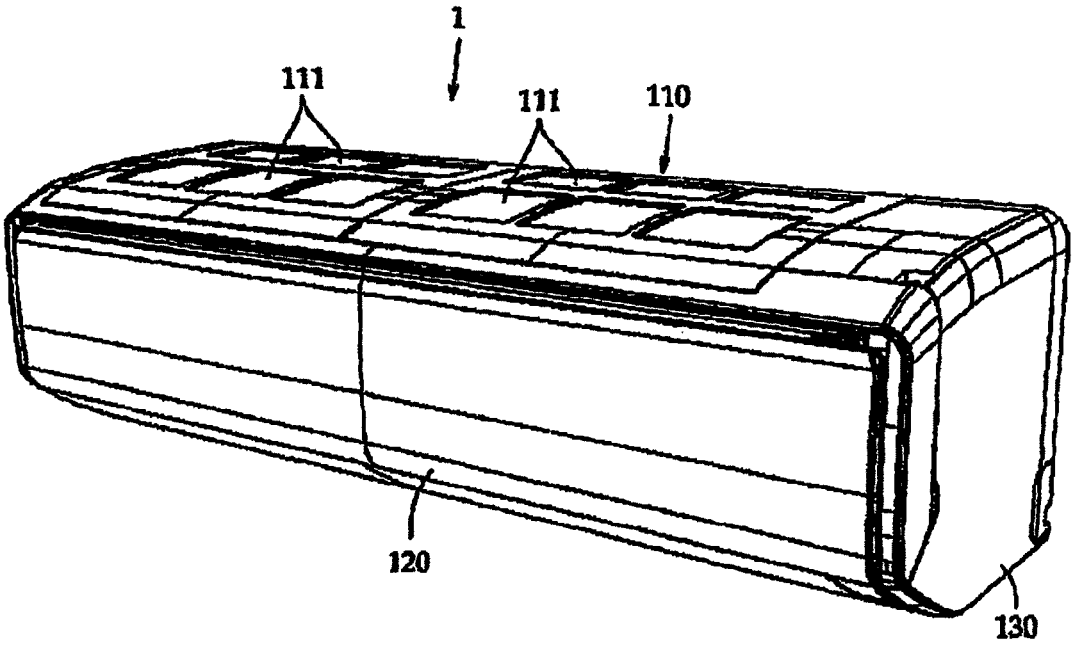
FIG. 1 is a perspective view of an air conditioner (an indoor unit) of an embodiment of the present invention.
Figure 2:
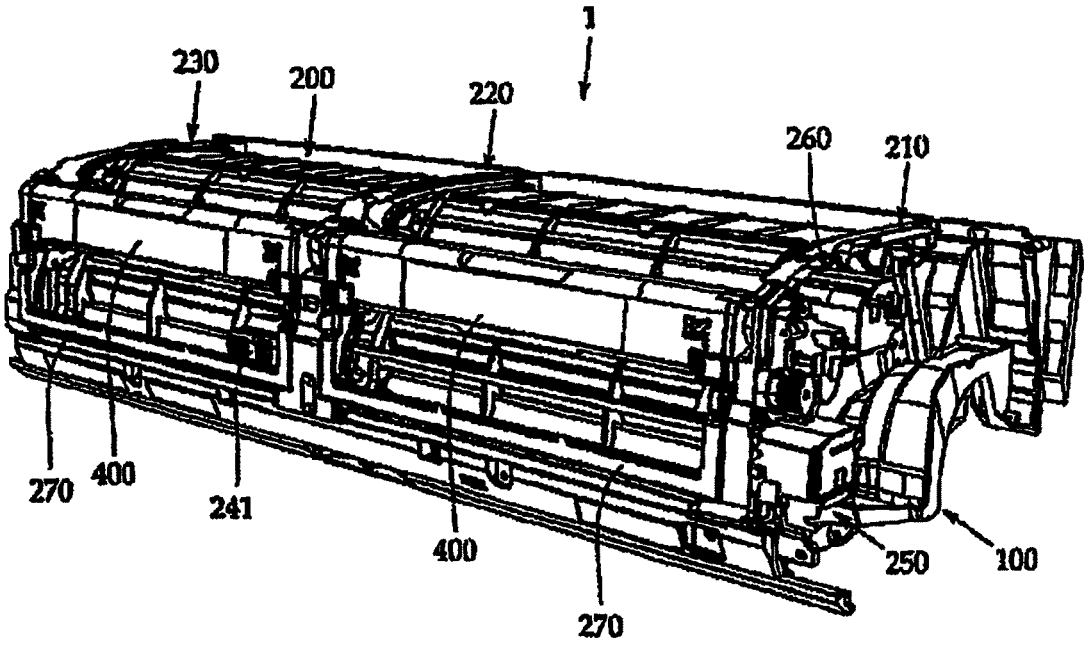
FIG. 2 is a perspective view showing a state where a decoration panel of the air conditioner is removed.
Figure 3:
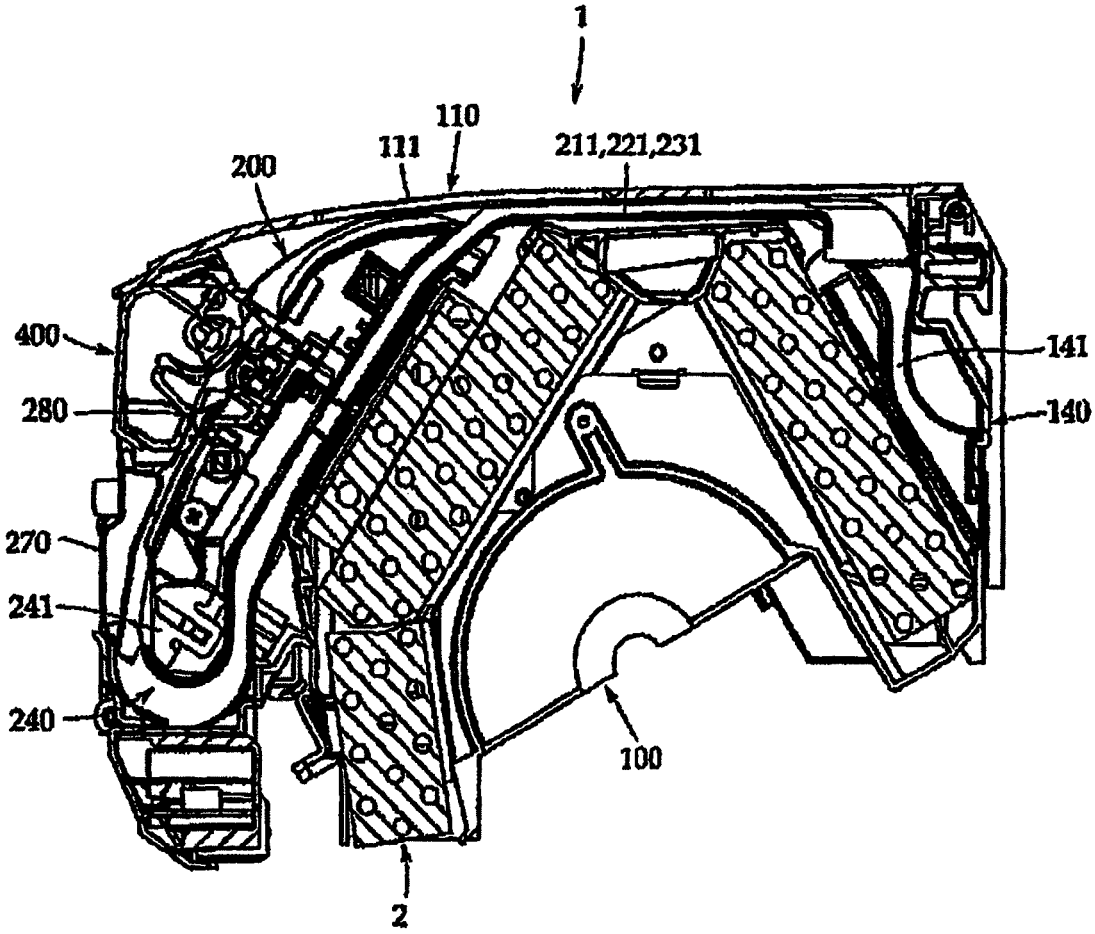
FIG. 3 is a cross-sectional view of the principal section from which a part of the air conditioner is omitted.

An embodiment of the present invention will now be described by reference to the drawings, but the present invention is not limited to the embodiment. As shown in FIGS. 1 through 3, an indoor unit 1 of an air conditioner has a base panel 100 to be supported on a wall by way of an unillustrated rear panel. The base panel 100 is provided integrally with an upper panel 110 serving as a decoration plate, a front panel 120, and side panels 130. In the embodiment, the respective panels are formed from molded products formed from a synthetic resin.

Air inlet grills 111 for taking an air into the indoor unit 1 are formed in the upper panel 110. The inlet grills are formed by means of opening or closing of a portion of the front panel 120, which is not illustrated in the embodiment.

A heat exchanger 2 and a cross flow fan (not shown) are supported on the base panel 100. Since, in the present invention, the specific configuration of the heat exchanger 2 and the specific configuration of the cross flow fan can be arbitrary, their explanations are omitted.

Air outlets, wind direction plates, a diffuser, and the like, are provided in and on a lower side of the base panel 100. However, in the present invention, these elements are not subjected to specific limitations, and hence their explanations are also omitted.

A guide panel 140 for drawing a portion of a filter 3 driven by a filter cleaning unit 200 toward a rear surface side of the base panel 100 is provided on the rear surface of the base panel 100 along a rear-surface-side heat exchanger.

The guide panel 140 has an S-shaped filter guide channel 141 (a second bypass channel) opened toward the rear end of the filter cleaning unit 200, and a rear end of the filter 3 is guided into the filter guide channel 141.

The filter cleaning unit 200 that supports the filters 3, 3 and that cleans dust adhering to the filters 3, 3 is interposed between the upper panel 110 and the heat exchanger 2.

In the example, the filter 3 has two filters; namely, aright filter 3A for covering a right half of the heat exchanger 2 and a left filter 3B for covering a left half of the heat exchanger 2. The filters 3A and 3B have the same shape, and hence only one of the filters is described, and explanations of the other filter are omitted.

Figure 4:
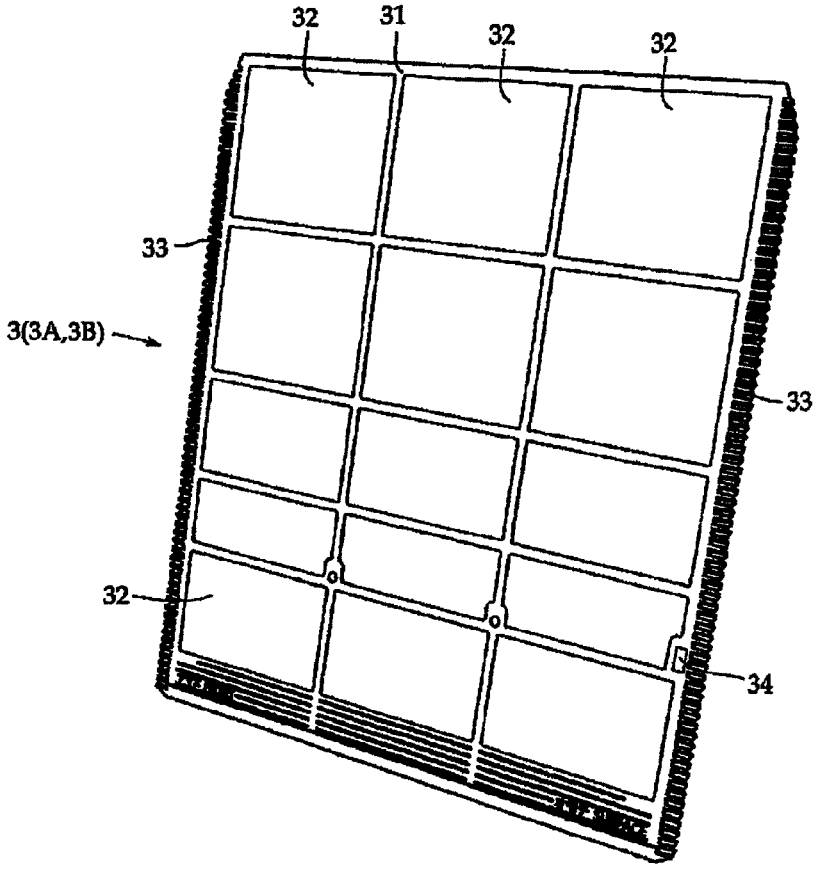
FIG. 4 is a perspective view of the filter of the air conditioner.

As shown in FIG. 4, the filter 3 is formed from a molded product made of a synthetic resin; for instance, polypropylene, and a frame 31 and a mesh 32 are formed integrally on the filter. The filter 3 preferably contains a conductive resin for preventing buildup of static electricity and more preferably may also be added with an additive, such as an antimicrobial material.

Movement rails 33, 33 for reciprocally moving the filter 3 backwardly and forwardly with reference to the dust box 300 are provided at both ends of the frame 31 in its horizontal direction. Racks are formed in the respective movement rails 33, 33 so as to mesh with feed gears 212 and 232 provided on the filter cleaning unit 200 to be described later.

A notch hole 34 for detecting the position of the filter 3 is formed in a part of the frame 31. As a result of a position detection sensor 280 (see FIG. 3) being fitted into the notch hole 34, the position of the filter 3 is detected. In the present embodiment, the notch hole 34 is provided in a part of the frame 31 formed along one of side surfaces of the movement rails 33, 33, but the location for the notch hole is not particularly specified.

In the present embodiment, the position detection sensor 280 is constituted of a limit switch provided on a filter support surface 211 of a first support frame 210 and a limit switch provided on a filter support surface 231 of a third support frame 230. However, the position detector other than the limit switches may also be provided.

Figure 5:
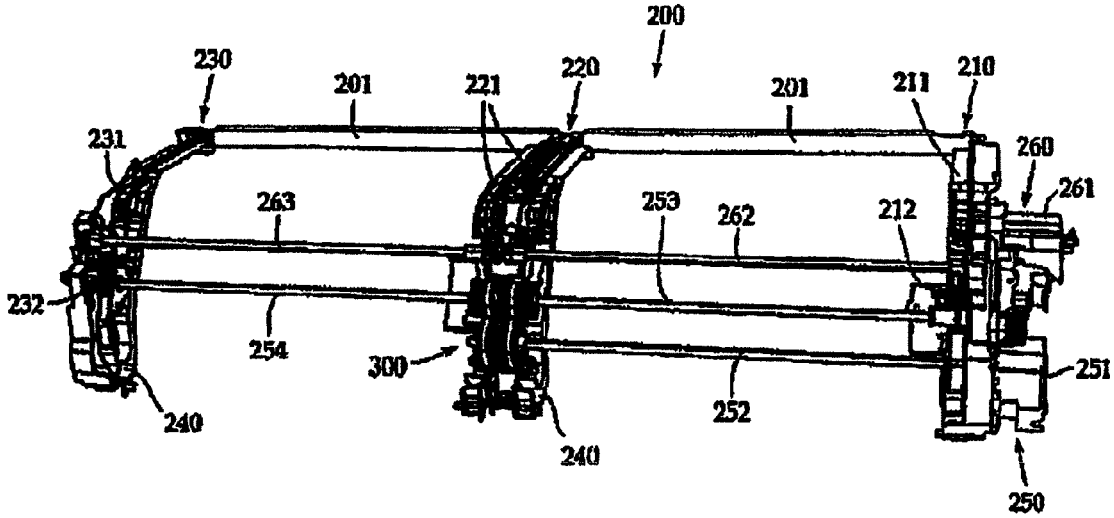
FIG. 5 is a perspective view of a filter cleaning unit of the air conditioner.
Figure 6:
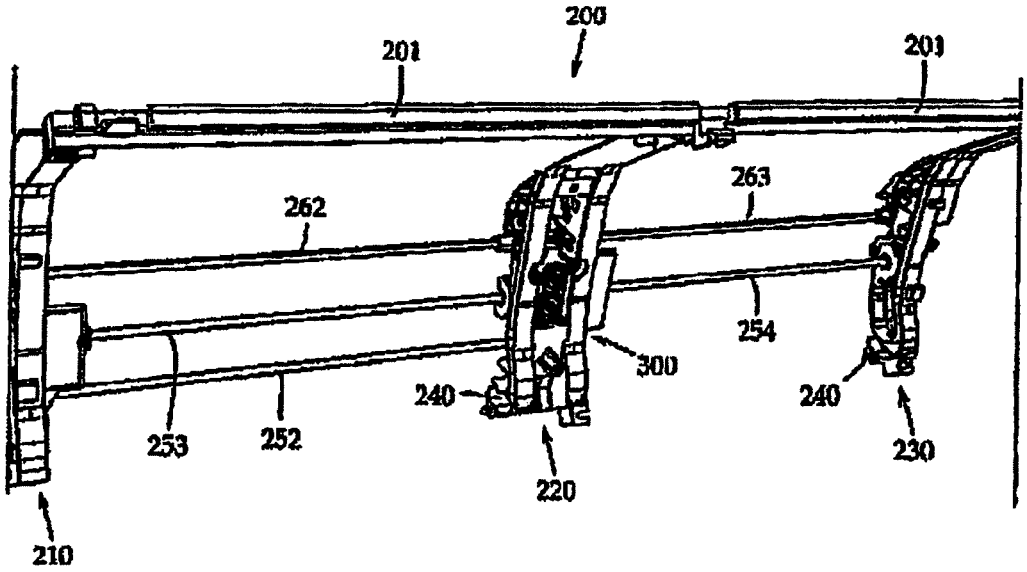
FIG. 6 is a partially-enlarged perspective view of the filter cleaning unit when viewed from the rear.

As shown in FIGS. 5 and 6, the filter cleaning unit 200 has the first support frame 210 for supporting the right movement rail 33 of the right filter 3A; a second support frame 220 for supporting the left movement rail 33 of the right filter 3A and the right movement rail 33 of the left filter 3B, and the third support frame 230 for supporting a left side surface of the left filter 3B. Upper ends of these support frames are linked together by means of a horizontal beam member 201.

Figure 7:
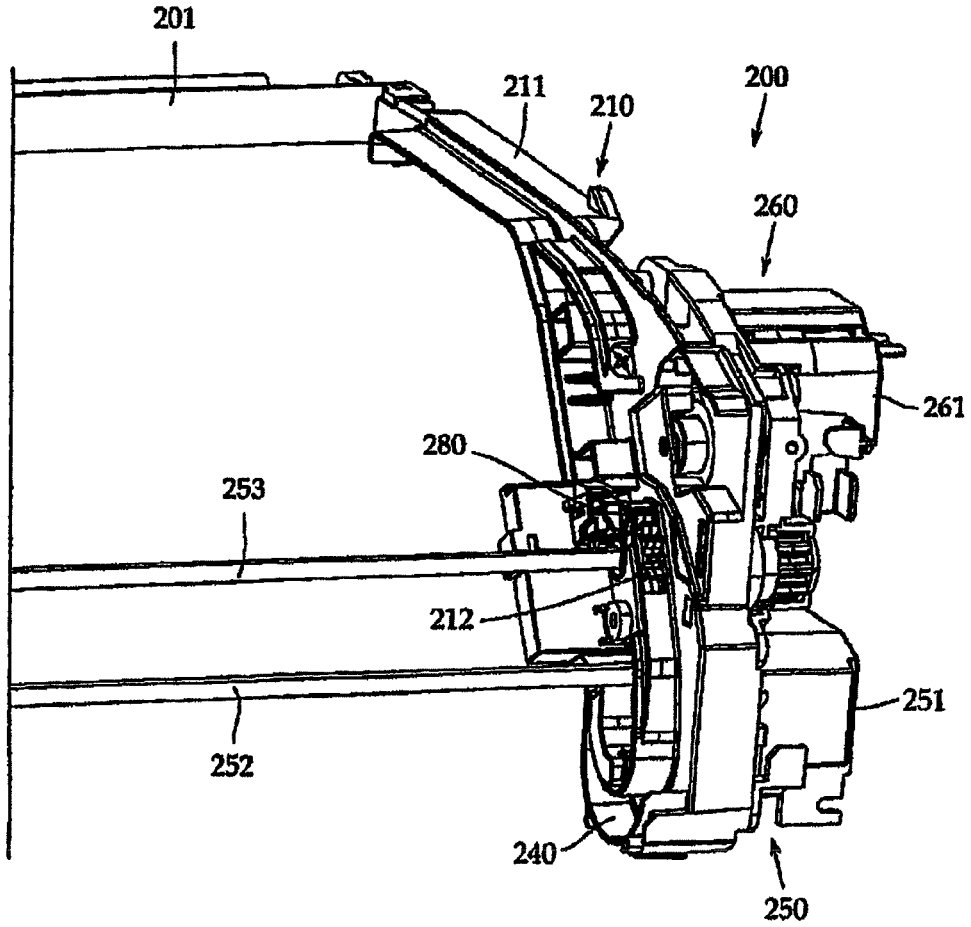
FIG. 7 is a partially-enlarged perspective view of the filter cleaning unit.

By reference to FIG. 7 in combination, the support frame 210 has the filter support surface 211; the support frame 220 has a filter support surface 221; and the support frame 230 has the filter support surface 231, wherein all of the filter support surfaces are formed in the shape of an arrow along the surface of the heat exchanger 2. Further, a U-shaped guide groove 240 (a first bypass channel) for making a return of the filter 3 without drawing the filter outside of the main unit during cleaning of the filter is provided in each of the support frames 210, 220, and 230.

As shown in FIG. 3, an inlet is opened in each of the guide grooves 240 toward the lower ends of the respective filter support surfaces 211, 221, and 231. The inlets are folded in the shape of the letter U and raised to the upper panel 110 along the front-surface-side heat exchanger. Upper ends of the guide grooves 240 are formed so as to merge with upper panel sides of the respective filter support surfaces 211, 221, and 231.

By reference to FIG. 2 in combination, a temperature sensor 250 for measuring the temperature of an air taken in by way of the air inlet is placed in respective U-shaped spaces of the guide grooves 240. In the present embodiment, the temperature sensors 250 are set in the folded spaces of the guide grooves 240, but various sensors, such as a humidity sensor, other than the temperature sensor may also be provided.

The filter cleaning unit 200 is provided with movement section 250 for moving the filter 3. The movement section 250 has a motor 251 mounted integrally on a side surface of the first support frame 210; a first transmission shaft 252 for inputting rotational drive force of a motor 251 to a clutch 300 provided on a second support frame 220; a second transmission shaft 253 for transmitting rotational drive force to the first support frame 210 by way of the clutch 300; and a third transmission shaft 254 for transmitting rotational drive force to the third support frame 230 by way of the clutch 300.

One end of the first transmission shaft 252 is connected to an output spindle of the motor 251, and the other end of the same is connected to an input side of the clutch 300. The first transmission shaft 252 is extended in parallel between the first support frame 210 and the second support frame 220.

One end of the second transmission shaft 253 is connected to an output side of the clutch 300, and the other end of the same is connected to the feed gear 212 provided so as to project to the support surface 211 of the first support frame 210. The second transmission shaft 253 is in parallel between the first support frame 210 and the second support frame 220. In the present embodiment, a feed gear 372 is provided on a bearing side of the second support frame 220 of the second transmission shaft 253, as well.

One end of the third transmission shaft 254 is connected to the output side of the clutch 300, and the other end of the same is connected to the feed gear 232 provided so as to project toward the support surface 231 of the third support frame 230. The third transmission shaft 254 is extended in parallel between the second support frame 220 and the third support frame 230. In the present embodiment, a feed gear 392 is provided on the second support frame 220 of the third transmission shaft 254, as well.

Figure 8:
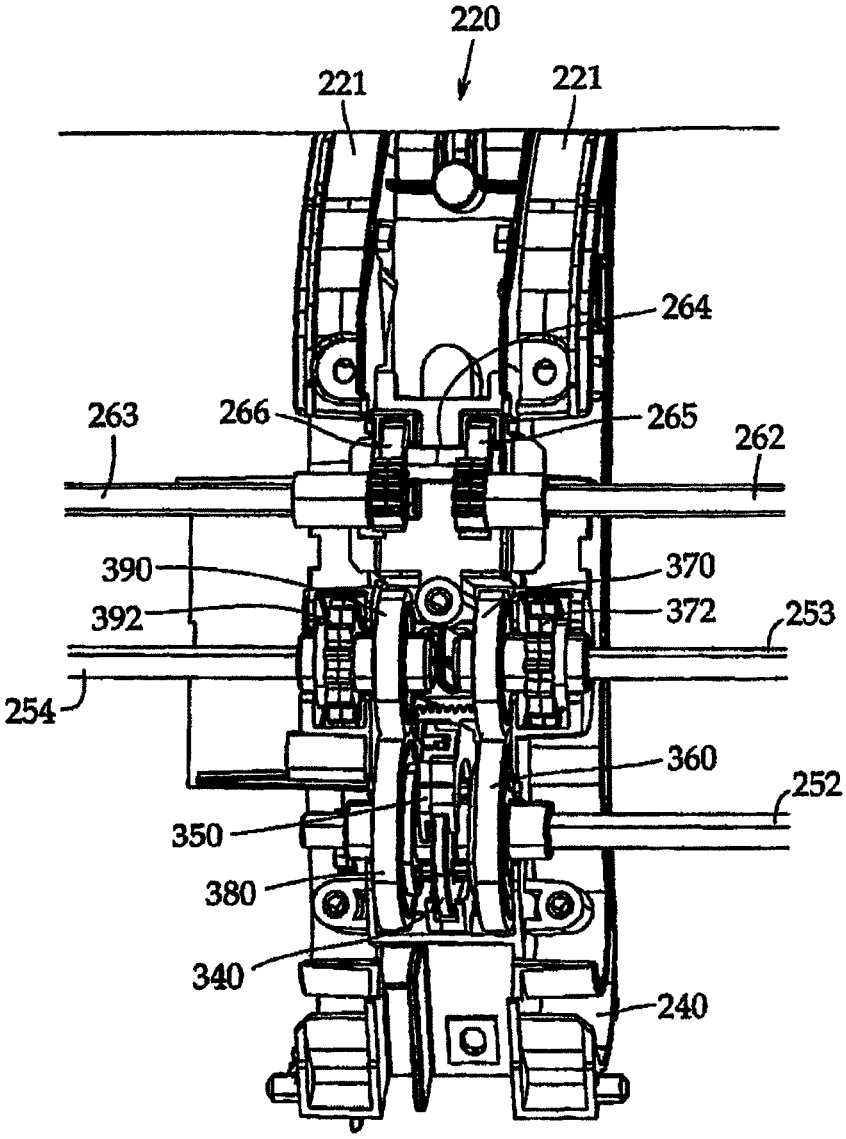
FIG. 8 is a partially-enlarged perspective view of a clutch unit of the filter cleaning unit.
Figure 9:
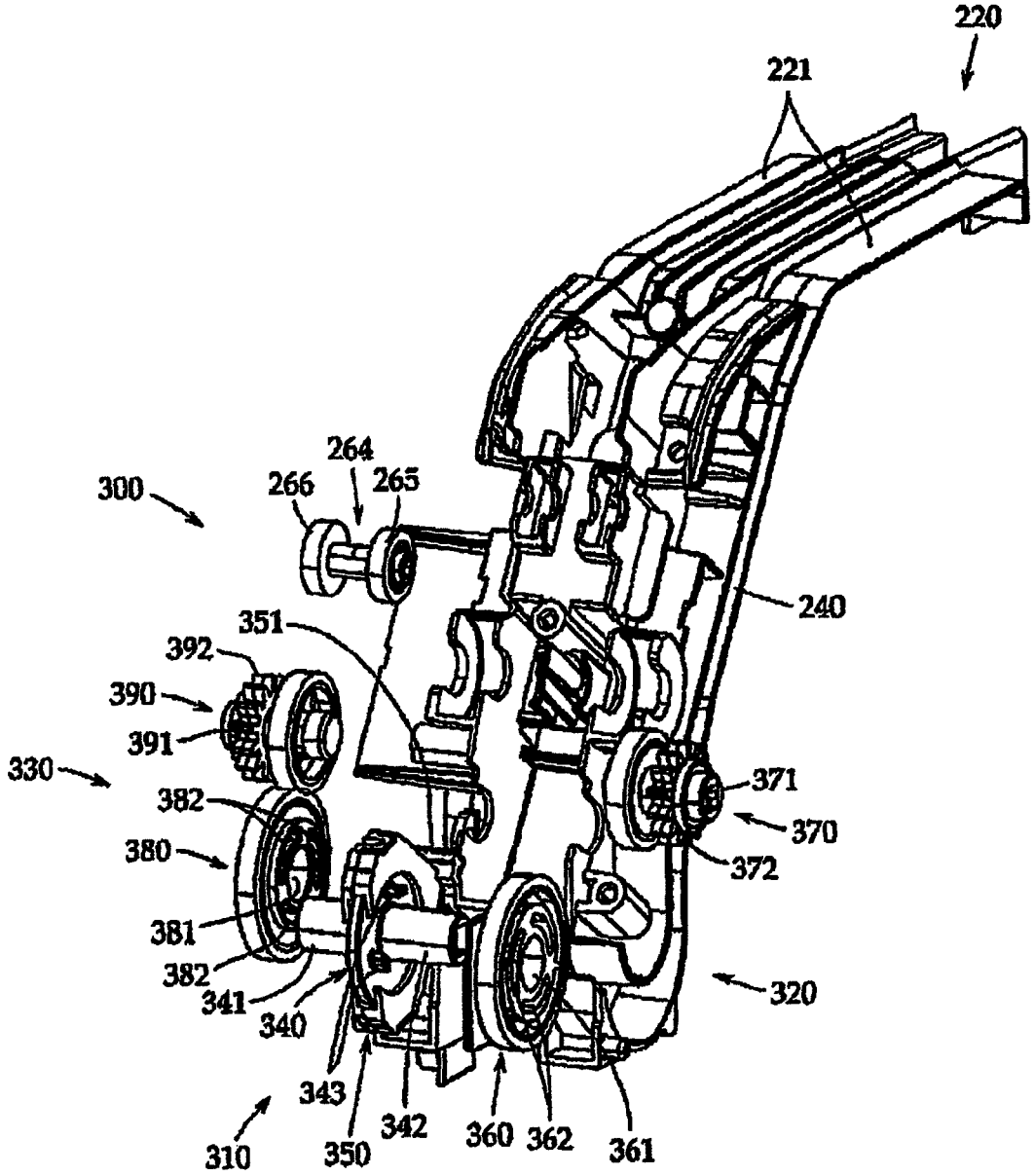
FIG. 9 is an exploded perspective view of the clutch unit.
Figure 10:
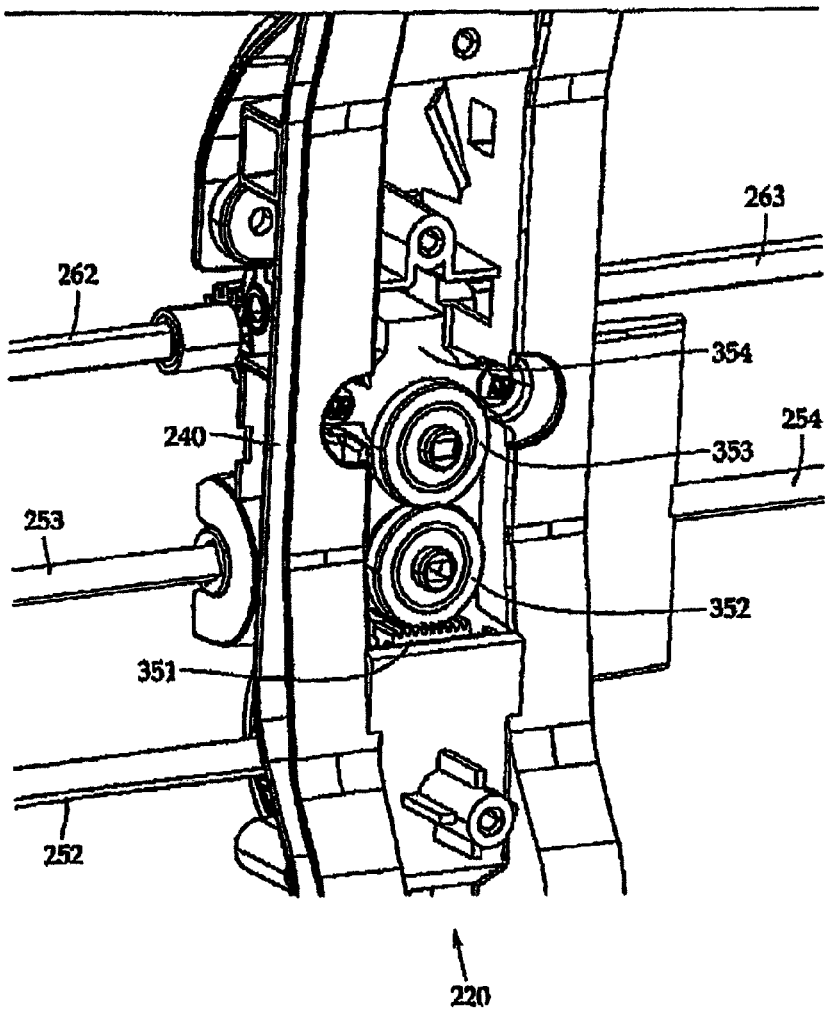
FIG. 10 is a partially-enlarged perspective view of the clutch unit when viewed from the rear.
Figure 11:
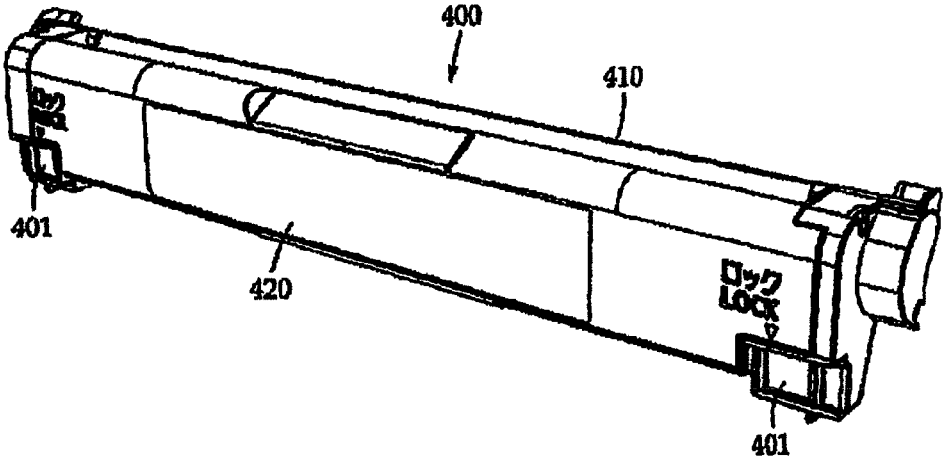
FIG. 11 is a perspective view of a dust box.

By reference to FIGS. 8 through 10, the clutch 300 is housed in a recess formed in the second support frame 220. The clutch 300 has a switching unit 310 for selectively switching a destination to which rotational drive force input by way of the first transmission shaft 252 is to be transmitted; a first drive gear unit 320 for moving the right filter 3A; and a second drive gear unit 330 for moving the left filter 3B.

In the present embodiment, the switching unit 310 is a so-called two-way clutch that transmits rotational drive force by means of selectively switching the first drive gear unit 320 and the second drive gear unit 330.

As shown in FIG. 9, the switching unit 310 has a rotator 340 that is rotated at all times by means of rotational drive force of the first transmission shaft 252 and a slider 350 that rotatably supports the rotator 340 and slides the rotator 340 right and left.

The rotator 340 is made up of a disc element coaxially attached to the center axis of the first transmission shaft 252. Slide guides 341 and 342, by means of which the slider 350 slides the rotator 340 right and left along the axial direction of the first transmission shaft 252, are coaxially provided in a protruding manner at both axial ends of the disc element.

Projections 343 for connecting the rotator 340 to the respective drive gear units 320 and 330 are provided on both side surfaces of the rotator 340 in its longitudinal direction. In the present embodiment, the projections 343 are provided at three positions at an interval of 120°. However, no specific limitations are imposed on the number and geometry of the projections 343.

The slider 350 is built from a support element that holds the rotator 340 in a freely-rotatable manner so as to surround the outer perimeter of the rotator 340. A rack gear 351 for moving the slider 350 right and left is formed integrally in the slider 350.

A slide gear 352 for sliding the slider 350 right and left, a transmission gear 353, and a drive motor 354 are provided on the back of the slider 350.

By reference to FIG. 10 in combination, the rack gear 351 is formed along the direction of sliding action of the slider 350 (a horizontal direction in FIG. 9). A slide gear 352 positioned on the rear surface side of the second support frame 220 meshes with the rack gear 351. The slide gear 352 further meshes with the drive motor 354 by way of a transmission gear 353, whereby the slider 350 is slid right and left in accordance with a rack-and-pinion mode.

The first drive gear unit 320 has a first drive gear 360 rotatably supported by a part of the second support frame 220 and a first transmission gear 370 that meshes with the first drive gear 360 and that is connected to the second transmission shaft 253.

The first drive gear 360 is built from a disc element whose outer perimeter is formed into a gear surface that meshes with the first transmission gear 370. Further, a bearing hole 361 that rotatably supports a slide guide 341 of the rotator 340 is opened in the center of the disc element.

Engagement holes 362 that mesh with the projections 343 of the rotator 340 are provided at three locations on a side surface of the first drive gear 360 along a circumferential direction thereof. In the present embodiment, the engagement holes 362 are formed so as to become larger than the projections 343 with slight play. By means of the configuration, even in a case where the projections 343 do not enter the engagement holes 362 when an attempt is made to cause the rotator 340 to mesh with the first drive gear 360 while rotating the rotator, the projections can be fitted, without fail, into the engagement holes 362 that will come next.

The first transmission gear 370 has a gear surface that meshes with the first drive gear 360, and an insert hole 371, by means of which the second transmission shaft 253 is supported, is coaxially opened in the center of the gear surface. A feed gear 372 that meshes with the racks 34 of the right filter 3A is provided integrally on a side surface of the first transmission gear 370.

The second drive gear unit 330 has a second drive gear 380 that is rotatably supported by a part of the second support frame 220 and a second transmission gear 390 that meshes with the second drive gear 380 and that is connected to a third transmission shaft 254.

The second drive gear 380 is built from a disc element whose outer perimeter is formed into a gear surface that meshes with the second transmission gear 390. Further, a bearing hole 381 that rotatably supports the slide guide 341 of the rotator 340 is opened in the center of the disc element.

Engagement holes 382 that mesh with the projections 343 of the rotator 340 are provided at three locations on a side surface of the second drive gear 380 along a circumferential direction thereof. In the present embodiment, the engagement holes 382 are formed so as to become larger than the projections 343 with slight play. By means of the configuration, even in a case where the projections 343 do not enter the engagement holes 382 when an attempt is made to cause the rotator 340 to mesh with the second drive gear 380 while rotating the rotator 340, the projections can be fitted, without fail, into the engagement holes 382 that will come next.

The second transmission gear 390 has a gear surface that meshes with the second drive gear 380, and an insert hole 391, by means of which the third transmission shaft 254 is supported, is coaxially opened in the center of the gear surface. A feed gear 392 that meshes with the racks 33 of the left filter 3B is provided integrally on a side surface of the second transmission gear 390.

According to the above descriptions, when moved to the right as a result of selective horizontal movement of the rotator 340 by way of the slider 350, the rotator 340 is linked to the first drive gear unit 320, thereby enabling driving of the right filter 3A. Conversely, when moved to the left, the rotator 340 is linked to the second drive gear unit 330, thereby enabling driving of the left filter 3B.

As shown in FIGS. 5 and 6, the filter cleaning unit 200 has brush rotation section 260 for rotating a cleaning brush 430 provided in a dust box 400 to be described later.

The brush rotation section 260 has a drive motor 261 provided integrally on a side surface of the first support frame 220; a first rotary shaft 262 for rotating a cleaning brush 430 of a dust box 400 on the part of the right filter 3B; and a second rotary shaft 263 for rotating the cleaning brush 430 provided in the dust box 400 on the part of the left filter 3B.

One end of the first rotary shaft 262 is connected to an output shaft of the drive motor 261, and the other end of the same is extended to the second support frame 220 in a rotatable manner. A gear 265 that meshes with a rotary gear 433 exposed on the rear surface side of the dust box 400 is provided at the other end of the first rotary shaft 262.

The second rotary shaft 263 is linked to the first rotary gear 262 by way of a link member 264. A gear 266 that meshes with the rotary gear 433 exposed on the rear surface side of the dust box 400 is provided at one end of the second rotary shaft 263. The other end of the second rotary shaft 263 is supported by the third support frame 230. A gear (not shown) for rotating the cleaning brush 430 is provided also on the second drive shaft 263.

By reference to FIG. 2, a dust box 400 for removing dust adhering to the filters 3, 3 is provided at two positions on the filter cleaning unit 200. Since the dust boxes 400 have the same shape, only one of the dust boxes is explained, and explanations of the other one are omitted.

As shown in FIGS. 11 through 14, the dust box 400 has a box main body 410 whose upper and lower surfaces are opened; a top panel 420 for covering an opening in the upper surface of the box main body 410, and a cleaning brush 430 disposed so as to be contactable with the surface of the filter 3. The entirety of the dust box 400 is built from a horizontal box that is extended to the support frames 210 and 220.

The box main body 410 is built from a cylindrical element whose upper and lower ends are opened. A dust recovery brush 440 for scraping dust adhering to the cleaning brush 430 is provided on one interior side surface. The dust recovery brush 440 has a circular-arc brush base 441 that turns around a predetermined horizontal rotary shaft, and a brush main body 442 is provided integrally along an interior circumferential surface of the brush base 441.

Stationary claws 401, 401 for fixing the dust box 400 to the filter cleaning unit 200 are provided on the front surface side of the box main body 410. The stationary claws 401, 401 are of slide type. The stationary claws 401, 401 are inserted into unillustrated insert holes opened in the filter cleaning unit 200, to thus be fastened to the filter cleaning unit 200.

Figure 14A:
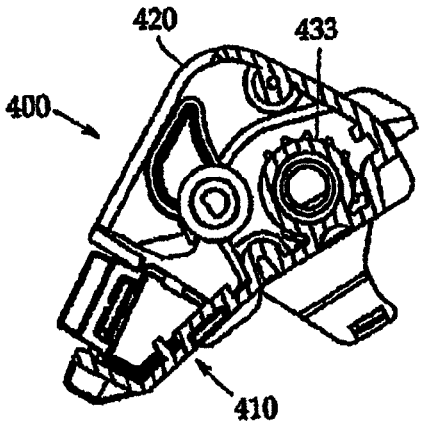
FIGS. 14A and 14B are cross-sectional views of the principal section of the dust box.
Figure 14B:
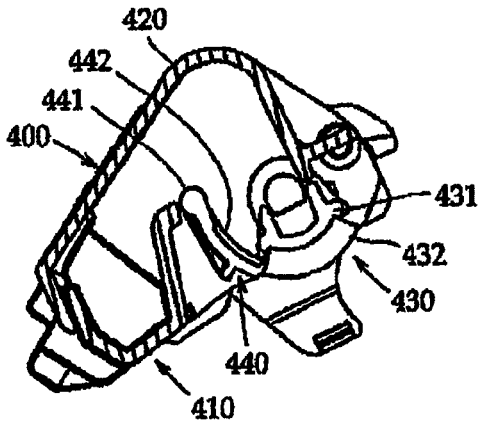

As shown in FIG. 14B, the brush base 441 is formed into a circular-arc shape such that the brush main body 442 contacts the brush base 441 along a locus of rotation of the cleaning brush 430. The brush main body 442 is built from an inclined brush that obliquely contacts the cleaning brush 430 with respect to the direction of rotation of the cleaning brush 430.

The top panel 420 is built from a rectangular panel formed along an upper surface of the box main body 410, and one end of the top panel 420 is reclosably attached by way of a predetermined horizontal rotary shaft. A free end of the top panel 420 is fastened to the box main body 410 by way of unillustrated lock section.

By reference to FIGS. 14A and 14B, the cleaning brush 430 has a brush base 431 that is supported so as to be rotatable around a predetermined horizontal rotary shaft. A brush main body 432 is provided integrally on apart of the outer peripheral surface of the brush base 431.

Figure 12:
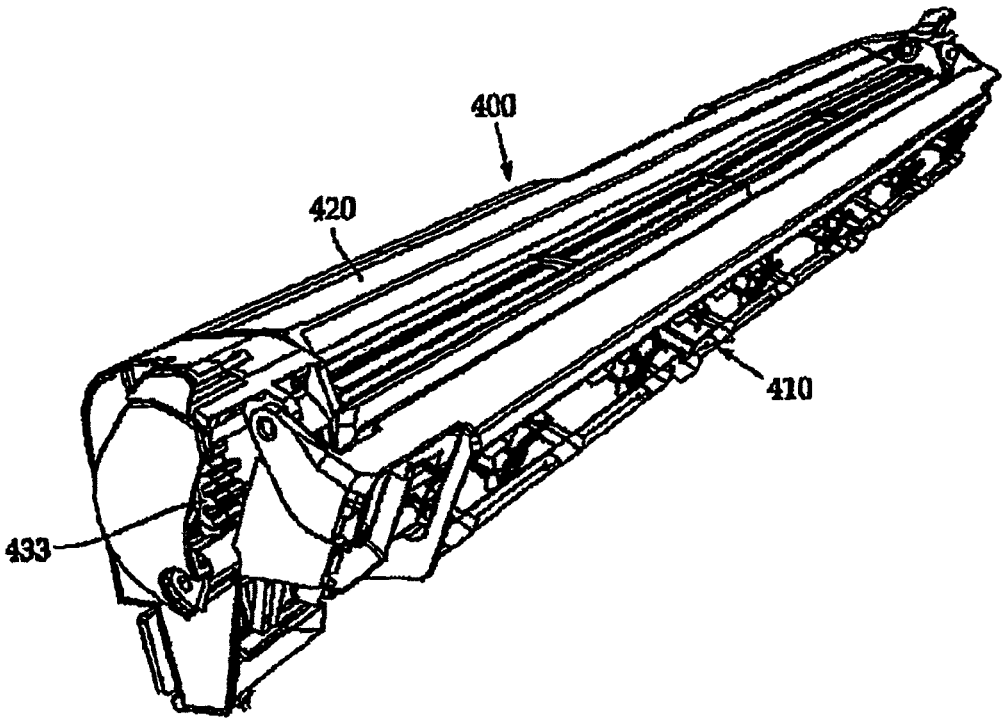
FIG. 12 is a perspective view of the dust box when viewed from the rear.
Figure 13:
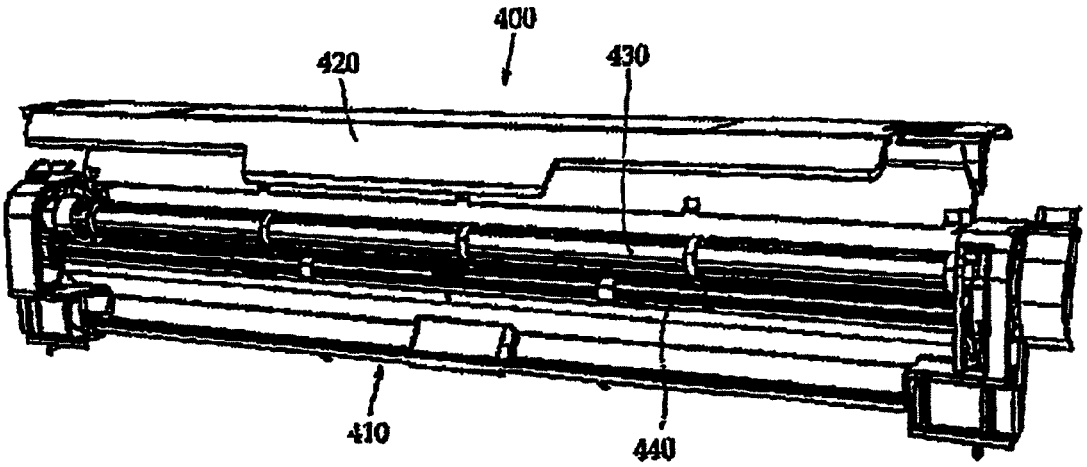
FIG. 13 is a perspective view showing a state where a top panel of the dust box is opened.

A rotational gear 433 for rotating the brush base is coaxially provided at both ends of the brush base 431. As shown in FIG. 12, a portion of the rotational gear 433 is exposed on the rear side of the dust box 400 and meshes with gears 265, 266 of the brush rotation section 260.

The brush base 431 is provided so as to extend along the longitudinal internal peripheral surface of the box main body 410, and the entirety of the brush base is formed into a semi-cylindrical shape. In the present embodiment, the brush main body 432 is built from an inclined brush in which brush hairs are radially implanted toward the direction of an outer periphery, but the shape of the brush may also be arbitrarily selected according to specifications.

Figure 15:
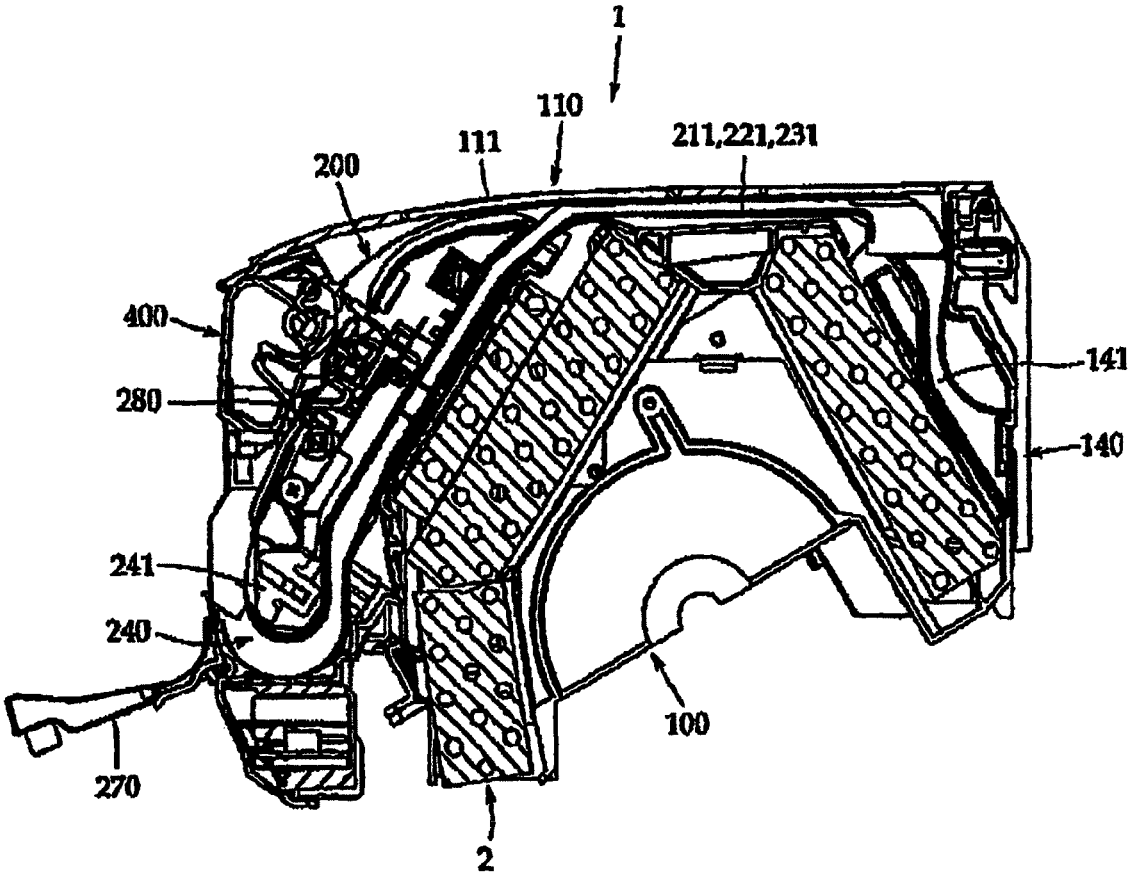
FIG. 15 is a cross-sectional view of the principal section achieved when a reclosable plate is opened.

By reference to FIG. 15, the filter cleaning unit 200 further has a reclosable plate 270 for guiding the filters 3, 3 to the filter support surfaces 211 to 231 when the filters 3, 3 are attached to the filter cleaning unit 200.

The reclosable plate 270 is provided so as to be rotatable around a horizontal rotary shaft 271 provided at one end and arranged so as to enable removal and attachment of the filters 3 by opening the reclosable plate 270.

Figure 16:
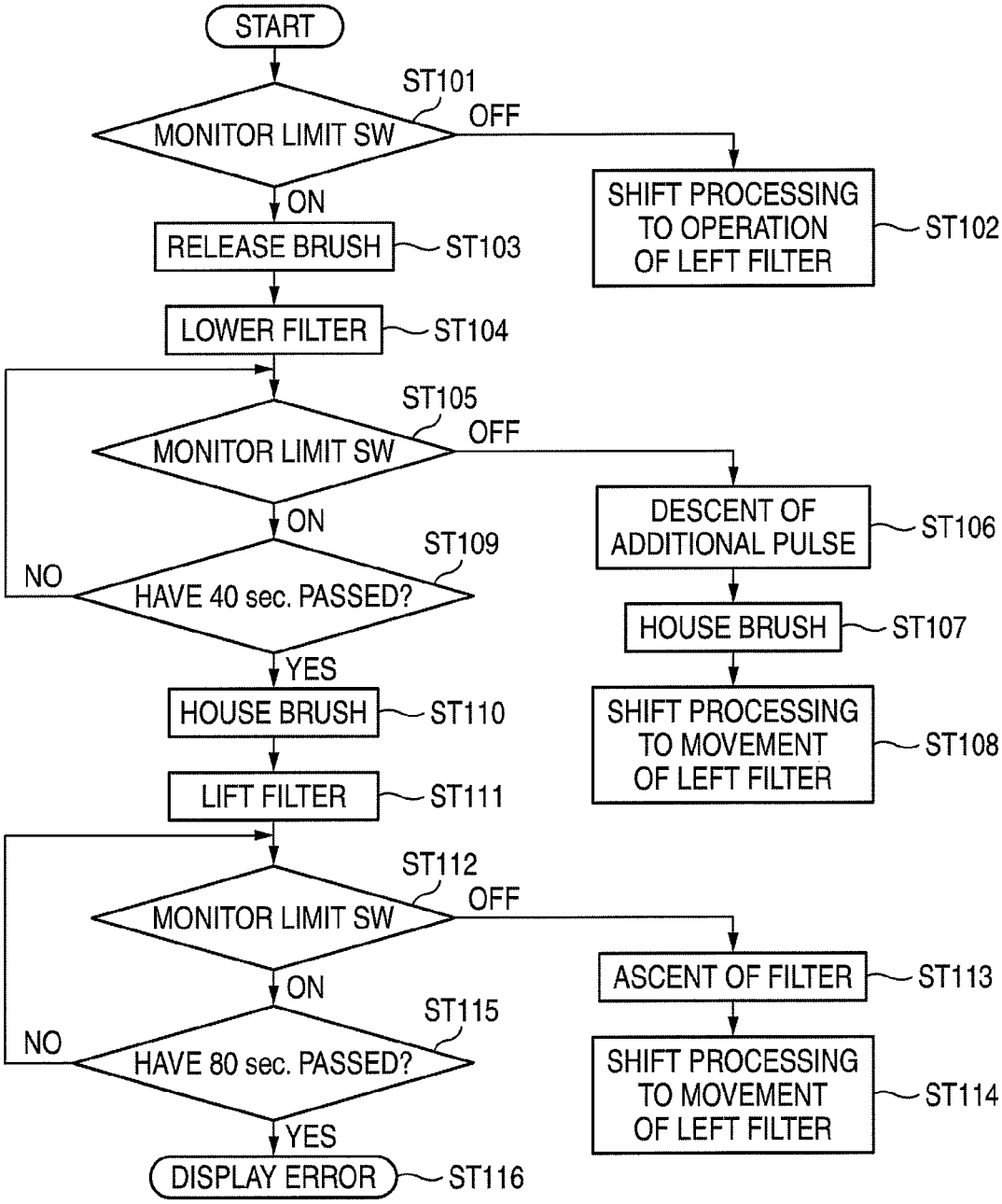
FIG. 16 is a flowchart of a process for initializing a right filter.
Figure 17:
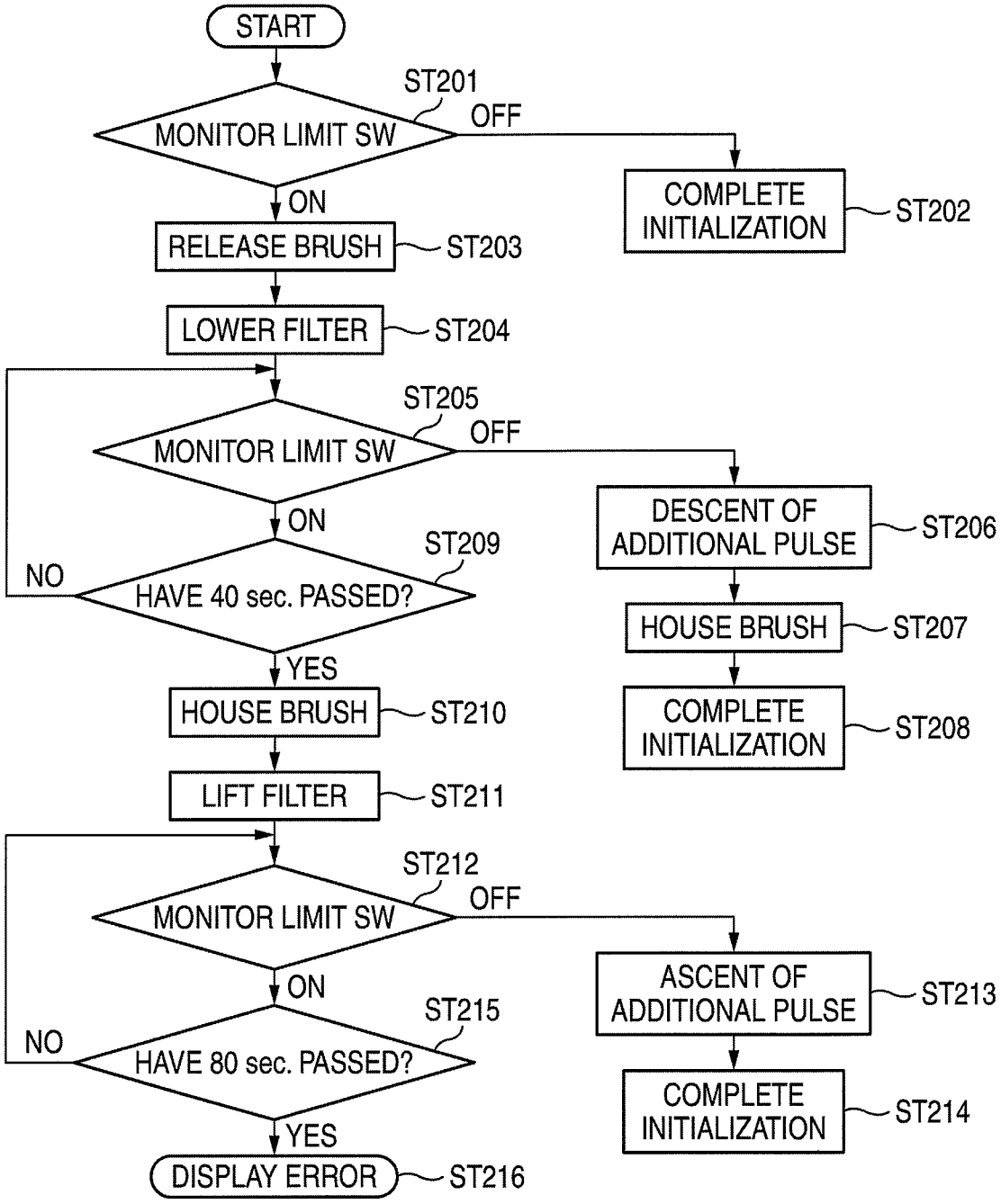
FIG. 17 is a flowchart of a process for initializing a left filter.

By reference to flow charts shown in FIGS. 16 and 17, example control of processes for initializing a filter will now be described. The indoor unit 1 is assumed to be previously equipped with the filter 3.

First, when a command for starting operation is output to the indoor unit 1 as a result of the user operating a remote controller, or the like, an unillustrated control section provided in the indoor unit 1 starts initialization of the right filter 3A.

The control section received a command determines whether or not a limit switch 280 for monitoring the right filter 3A is in an ON position or an OFF position (ST101). When the limit switch 280 is in the OFF position, the limit switch 280 is fitted to the notch hole 34 of the filter 3. Namely, the filter is determined to be situated at a normal position, and processing proceeds to a left filter initialization process provided below (ST102).

When the limit switch 280 is in the ON position, the control section determines that the filter is displaced from the normal position. In order to prevent fall of the filter from the dust box 400, which would otherwise be caused when the filter is lowered in next step ST104, the control section issues a command to the brush rotation section 260, thereby taking the cleaning brush 430 out of the dust box 400 and bringing the cleaning brush 430 in contact with the filter 3, thereby preventing fall of the filter (ST103).

Next, the control section issues a command to movement section 250, thereby rotating the motor 251. Further, the control section issues a command to the clutch 300, thereby sliding the slider 350 toward the first drive gear 360. Thus, the right filer 3A starts lowering operation (ST104).

During the course of lowering operation of the right filter 3A, the control section monitors the state of the limit switch 280 at all times (ST105). Upon receipt of an OFF signal from the limit switch 280, the control section issues a stop command to the movement section 250. However, at that time, when the movement section is stopped immediately after receipt of the OFF signal, a weak contact arises between the limit switch 280 and the notch hole 34, which may immediately turn on the switch the moment something or other happens.

Accordingly, the control section received the OFF signal feeds the right filter 3A by a slight extent and sends an additional pulse to the movement section in such a way that the limit switch 280 comes to the center of the notch hole 34 (ST106).

Next, the control section issues a command to the brush rotation section 260 and stores the cleaning brush 430 in the dust box 400 (ST107) and completes initialization of the right filter 3A, and processing proceeds to a process for initializing the left filter 3B (ST108).

Conversely, when transmission of an ON signal from the limit switch 280 is continual, the control section continues monitoring the limit switch 280 until an unillustrated timer counts to 40 seconds (ST109).

After elapse of 40 seconds, the initial position of the filter is determined to be higher than a set initial position (a position where the limit switch 280 meets the notch hole 34), and a command is sent to the brush rotation section 260, thereby housing the cleaning brush 430 in the dust box 400 (ST110).

After ascertaining storage of the cleaning brush 430, the control section sends a filter lift command to the movement section 250. Upon receipt of the command, the movement section 250 reversely rotates the motor 251, thereby lifting the right filter 3A (ST111).

The control section monitors the state of the limit switch 280 at all times during ascending operation of the right filter 3A (ST112). Upon receipt of the OFF signal from the limit switch 280, the control section issues a stop command to the movement section 250 after having sent the foregoing additional pulse to the movement section 250 (ST113). Thereafter, the control section completes initialization of the right filter 3A and shifts to a process for initializing the left filter 3B (ST114).

Conversely, in course of continual transmission of the ON signal from the limit switch 280, the control section continually monitors the limit switch 280 until the unillustrated timer counts to 80 seconds (ST115). Subsequently, the control section determines that the current state is an anomalous state where a filter does not operate and issues an alarm to the user by way of an unillustrated display section or alarm section (ST116).

The process for initializing the left filter 3B is basically identical with the process for the right filter 3A. Specifically, as shown in FIG. 17, the control section received a command for initializing the left filter 3B first determines whether the limit switch 280, which monitors the left filter 3B, is in the ON position or the OFF position (ST201). When the limit switch 280 is in the OFF position, the filter position is determined to be a normal position, and processing pertaining to the initialization process is completed (ST202).

When the limit switch 280 is in the ON position, the control section determines that the filter is displaced from the normal position and issues a command to the brush rotation section 260, thereby drawing the cleaning brush 430 out of the dust box 400 (ST203).

Subsequently, the control section issues a command to the movement section 250, to thus rotate the motor 251; and issues a command to the clutch 300, thereby sliding the slider 350 toward the second drive gear 380. The left filter 3B hereby starts descending operation (ST204).

The control section monitors the state of the limit switch 280 at all times in the middle of descending operation of the left filter 3B (ST205). Upon receipt of the OFF signal, the control section stops the left filter 3B after sending an additional pulse to the movement section 250 (ST206).

Next, the control section issues a command to the brush rotation section 260, thereby putting the cleaning brush 430 in the dust box 400 (ST207); completes initialization of the left filter 3B; and proceeds to the process for initializing the left filter 3B (ST208).

Reversely, in course of continual transmission of the ON signal from the limit switch 280, the control section continues monitoring the limit switch 280 until the unillustrated timer counts to 40 seconds (ST209). When 40 seconds elapse, the control section determines that the position where the filter is attached is positioned lower than an initial set position. In order to prepare for causing the filter to ascend in step ST211, a command is issued to the brush rotation section 260, and the cleaning brush 430 is put in the dust box 400 (ST210).

After ascertaining housing of the cleaning brush 430, the control section issues a filter lift command to the movement section 250. Upon receipt of the command, the movement section 250 reversely rotates the motor 251, thereby lifting the left filter 3B (ST211).

In course of ascending of the left filter 3B, the control section monitors the state of the limit switch 280 at all times (ST212). When the OFF signal is received from the limit switch 280, the foregoing additional pulse is sent to the movement section 250, and a stop command is sent to the movement section 250 (ST213). Subsequently, the control section completes initialization of the left filter 3B and shifts to the initialization process (ST214).

Reversely, in course of continual transmission of the ON signal from the limit switch 280, the control section continually commands monitoring of the limit switch 280 until the unillustrated timer counts to 80 seconds (ST215); and determines that the current state is an anomalous state and issues an alarm to the user by way of the unillustrated display section or alarm section (ST216).

Figure 18:
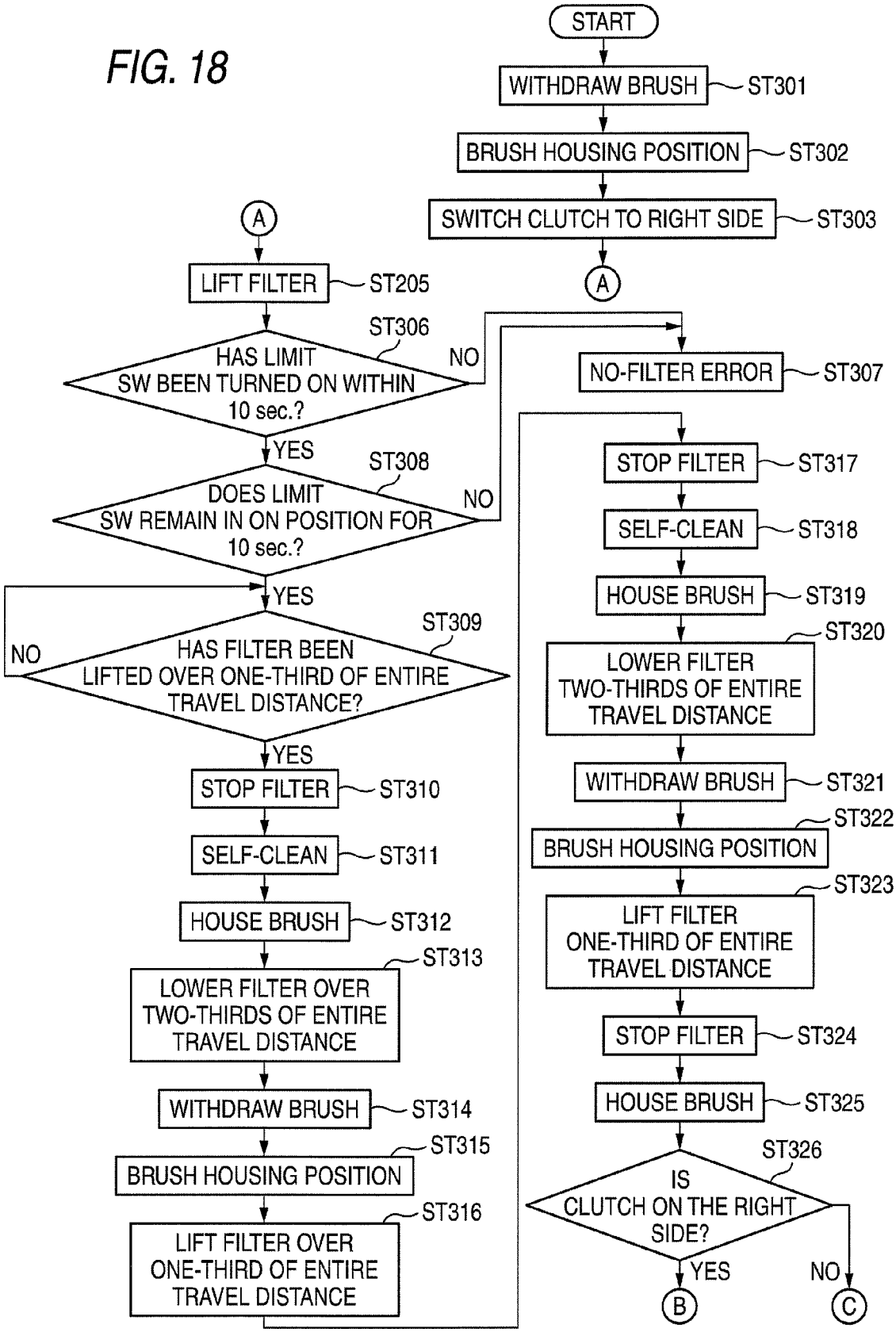
FIG. 18 is a flowchart of a filter cleaning process.
Figure 19:
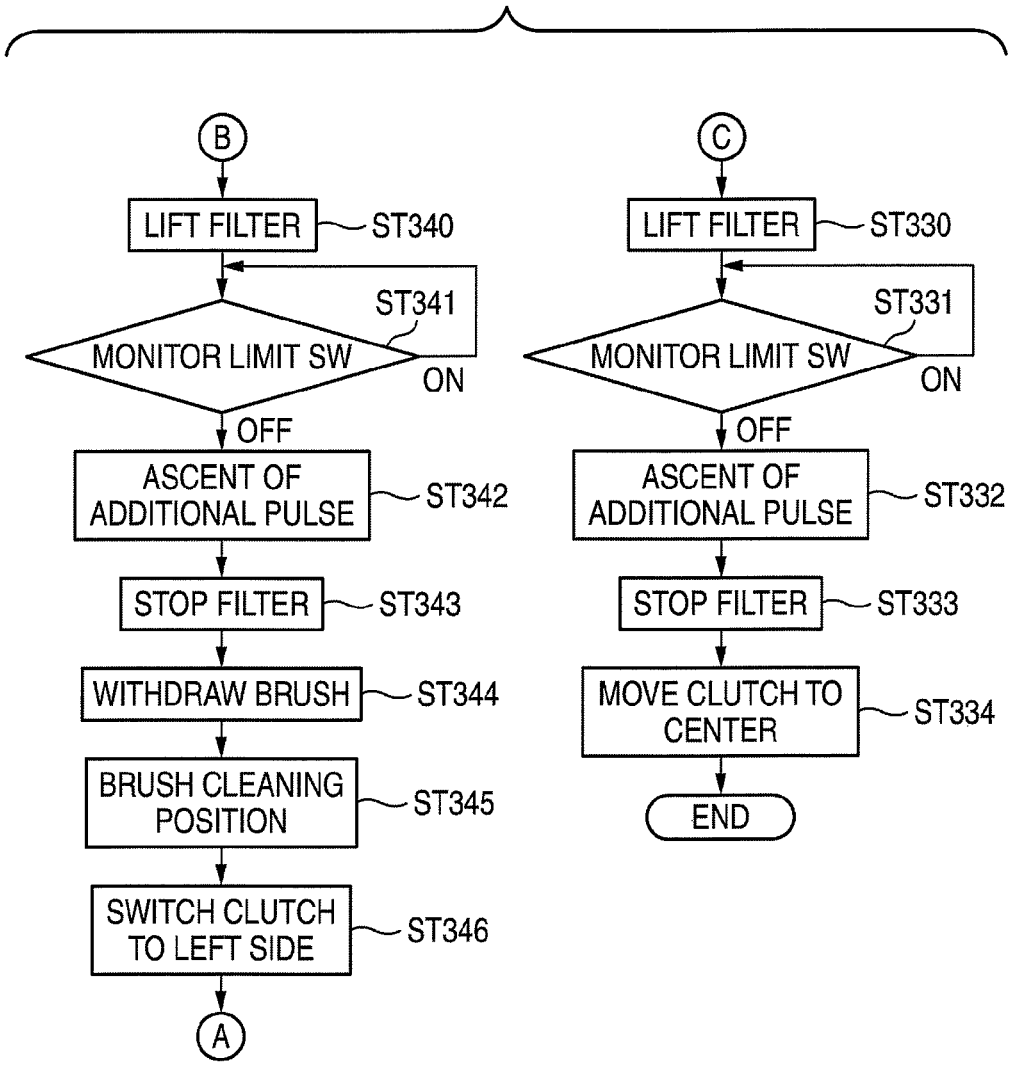
FIG. 19 is a flowchart of the filter cleaning process.

Example control of the process for cleaning a filter will now be described by reference to FIGS. 18 to 20. Upon receipt of a command for starting processing pertaining to the cleaning processing, the control section first issues a command to the brush rotation section 260, thereby drawing the cleaning brush 430 stored in the dust box 400 (ST301).

Since the cleaning brush 430 is inclined downwardly, hairs of the brush are smoothed down on the surface of the filter when the cleaning brush is rotationally drawn from the brush storage position. Accordingly, the control section issues a command to the brush rotation section 260, thereby slightly rotating the cleaning brush 430 in the direction of housing (ST302). The hairs of the brush are hereby brought into contact with the surface of the filter in an upstanding position.

Figure 20A:
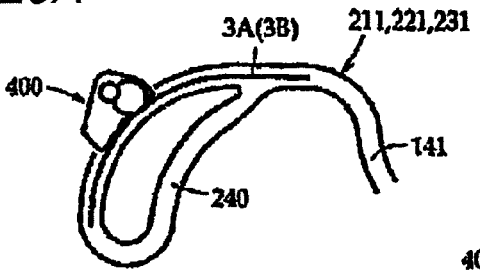
FIGS. 20A to 20F are schematic diagrams for describing movements of a filter achieved in a process for cleaning a filter.
Figure 20B:
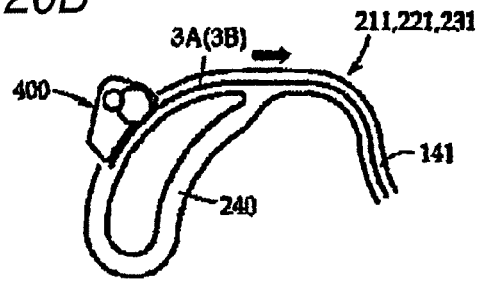

After bringing the brush hair in the foregoing state, the control section issues a command to the movement section 250, thereby rotating the motor 251; and issues a command to the clutch 300, thereby sliding the slider 350 toward the first drive gear 360 (ST304). Concomitantly, as shown in FIG. 20B, the right filter 3A starts ascending operation (ST305).

The control section determines whether or not the limit switch 280 is turned on within ten seconds in cooperation with timer (ST306). When determining that the limit switch is not turned on, the control section displays a no-filter error (ST307).

Conversely, when the ON signal is acquired within ten seconds, it is first determined whether or not the ON signal is continually received within ten seconds (ST308). When the ON signal is not continually received for ten seconds, the signal is considered to be suddenly output. The filter is considered to be in an anomalously-attached state; for instance, a reversely-attached state, and an error is displayed (ST307).

Figure 20C:
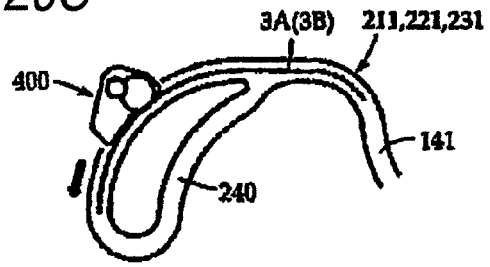

When the ON signal is continually transmitted for ten seconds, the control section ascertains whether or not the filter has moved one-third of the entire travel distance (ST309). As shown in FIG. 20C, after movement of the filter over one-third of the entire travel distance is ascertained, a stop command is issued to the movement section 250, thereby stopping movement of the filter (ST310). One-third of the area of the filter is hereby cleaned.

Upon ascertainment of stoppage of the filter, the control section issues a self-clean start command to the brush rotation section 260 (ST311). Upon receipt of the command, the brush rotation section 260 reciprocally moves the cleaning brush 430 three times, thereby causing the dust recovery brush 440 to scrape the dust adhering to the cleaning brush 430 and temporarily housing the cleaning brush 430 in the box 400 (ST312).

Figure 20D:
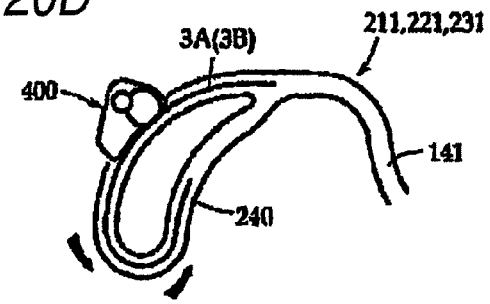

As shown in FIG. 20D, the control section issues a command to the movement section 250, to thus lower the filter two-thirds of the entire travel distance (ST313). Subsequently, the control section issues a command to the brush rotation section 260, thereby again drawing the cleaning brush 430 toward the filter (ST314) and slightly rotating the cleaning brush 430 in the direction of housing, to thus raise the hairs of the brush (ST315).

The control section issues a brush movement command to the movement section 250, thereby causing the filter to ascend one-third of the entire travel distance and cause the cleaning brush 430 to scrape the dust adhering to the filter (ST316). When the filter ascends one-third of the entire travel distance, the control section issues a stop command to the movement section 250 (ST317); again performs the foregoing self-cleaning operation (ST318); and temporarily stores the cleaning brush 430 in the dust box 400 (ST319).

Figure 20E:
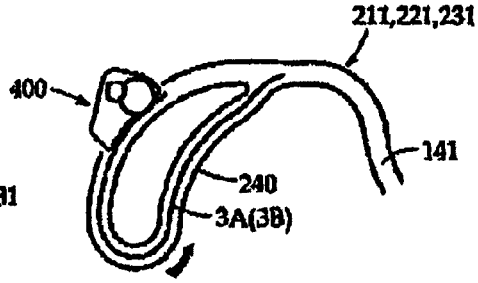

Next, the control section issues a filter movement command to the movement section 250, thereby moving the filter two-thirds of the entire travel distance (ST320). As a result, an upper end of the filter comes near to the dust box 400 as shown in FIG. 20E.

The control section sends a command to the brush rotation section 260 in this state, thereby drawing the cleaning brush 340 toward the filter (ST321). Further, the control section slightly rotates the cleaning brush 430 in the direction of housing, thereby raising brush hairs (ST322).

In this state, the control section issues a brush movement command to the movement section 250, thereby lifting the filter to one-third of the entire travel distance and causing the cleaning brush 430 to scrape the dust adhering to the filter (ST323). When the filter ascends one-third of the entire travel distance, the control section issues a stop command to the movement section 250 (ST324) and puts the cleaning brush 430 in the dust box 400 (ST325).

Figure 20F:
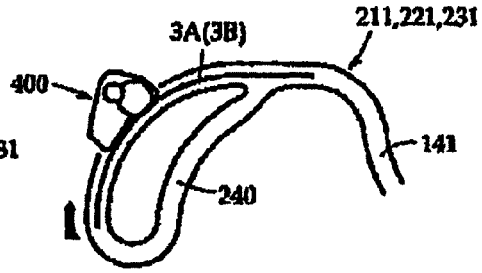

Next, the control section checks if the clutch 300 is on the right side (i.e., the part of the right filter 3A) (ST326). When ascertaining that the clutch 300 is on the right side, the control section issues a filter lift command to the movement section 250 as shown in FIG. 20F, thereby lifting the filter to the initial position (ST340).

In addition, the limit switch 280 is monitored (ST341). When the OFF signal from the limit switch 280 is received, an additional pulse rise command is sent to the movement section 250, thereby slightly lifting the filter (ST342) and subsequently stopping movement of the filter (ST343).

A command is subsequently sent to the brush rotation section 260, thereby drawing the cleaning brush 430 stored in the dust box 400 (ST344) and slightly rotating the cleaning brush 430 in the direction of housing, to thus raise the hairs of the brush (ST345).

Subsequently, the control section issues a switch command to the clutch 300, thereby switching the clutch 300 from the right side to the left side (ST346). Likewise, the control section thereafter iterates processing pertaining to the process for cleaning the left filter 3B from processing pertaining to step ST305.

When the clutch is determined not to be on the right side but on the left side, the control section issues a filter lift command to the movement section 250 as shown in FIG. 20F, thereby lifting the filter (ST330).

Further, the limit switch 280 is monitored (ST331). Upon receipt of the OFF signal from the limit switch 280, the additional pulse rise command is sent to the movement section 250, thereby slightly lifting the filter (ST332) and stopping the movement of the filter (ST333).

Subsequently, in order to idle the gears 370, 390 at the time of removal and attachment of the filter, the control section issues a neutral command to the clutch 300, thereby moving the clutch 300 to a neutral position and completing filter cleaning operation (ST334).

A round of filter cleaning processes is thus completed. However, processing pertaining to the filter cleaning process may also be arbitrarily by the user or automatically performed after elapse of a given operation time by way of a timer. Moreover, dust on the filter is monitored by a sensor, and filter cleaning may also be automatically performed when a given amount of dust builds up.

What is claimed is:

1. An air conditioner comprising:

a main unit cabinet that has at least an air inlet and a heat exchanger;

a dust removal filter disposed at an initial position opposite the air inlet within the main unit cabinet;

a cleaning unit provided within the main unit cabinet to remove dust adhering to the filter; and a movement apparatus provided within the main unit cabinet to move the filter, wherein the air inlet is formed from a front surface to an upper surface of the main unit cabinet;

a filter travel channel for the filter that is reciprocally moved by the movement apparatus is provided in the main unit cabinet;

the filter travel channel includes:

a first guide channel for making a U-turn of a leading end of the filter at a front surface side of the main unit cabinet during forward movement of the filter towards the initial position; and a second guide channel, wherein the second guide channel guides for guiding a rear end of the filter from the initial position to a secondary position at a rear surface side of the main unit cabinet during backward movement of the filter; the cleaning unit includes, wherein the second guide channel extends along said rear surface side of the main unit cabinet:

a dust box for removing dust adhering to the filter, and a cleaning brush moveable between a retracted position within the dust box and an extended position in contact with a surface of the filter, and wherein the movement apparatus is adapted to move the filter forward or backward, and movement of the filter causes the cleaning brush to move from the retracted position to the extended position.

2. The air conditioner according to claim 1, further comprising: a sensor disposed in a space surrounded by the first guide channel formed in the shape of the letter U.

3. The air conditioner according to claim 1, wherein a trailing end of the first guide channel is merged with a part of the filter travel channel close to the second guide channel, and a leading end of the filter folded by the first guide channel is intruded to the filter travel channel.

4. The air conditioner according to claim 1, wherein a part of the filter covering a front surface side of the main unit cabinet is first cleaned, and a part of the filter covering an upper side of the main unit cabinet is then cleaned.

5. The air conditioner according to claim 1, wherein the second guide channel is formed in the shape of the letter S and provided along the rear surface of the main unit cabinet.

* * * * *